US010077530B2

(12) United States Patent
Saito et al.

(10) Patent No.: US 10,077,530 B2
(45) Date of Patent: Sep. 18, 2018

(54) SHEET FORMER

(71) Applicant: BS Co., Ltd., Tokyo (JP)

(72) Inventors: Tsutomu Saito, Tokyo (JP); Ryohko Saito, Tokyo (JP); Kazushige Saito, Tokyo (JP)

(73) Assignee: BS Co., Ltd., Tokyo (JP)

( * ) Notice: Subject to any disclaimer, the term of this patent is extended or adjusted under 35 U.S.C. 154(b) by 0 days.

(21) Appl. No.: 15/329,009

(22) PCT Filed: Jul. 21, 2015

(86) PCT No.: PCT/JP2015/003659
§ 371 (c)(1),
(2) Date: Jan. 25, 2017

(87) PCT Pub. No.: WO2016/013213
PCT Pub. Date: Jan. 28, 2016

(65) Prior Publication Data

US 2017/0175330 A1 Jun. 22, 2017

(30) Foreign Application Priority Data

Jul. 25, 2014 (JP) ..... 2014-151972

(51) Int. Cl.
*D21F 1/04* (2006.01)
*D21F 9/04* (2006.01)
*D21G 9/00* (2006.01)

(52) U.S. Cl.
CPC ..... *D21F 1/043* (2013.01); *D21F 9/04* (2013.01); *D21G 9/0027* (2013.01)

(58) Field of Classification Search
CPC . D21F 9/04; D21F 9/043; D21F 1/043; D21F 1/046; D21F 1/06; D21G 9/0027; D21J 1/00; B28B 1/527; B28B 1/522
(Continued)

(56) References Cited

U.S. PATENT DOCUMENTS 1,766,000 A * 6/1930 Parker ..... D21F 9/04 162/326
1,801,238 A * 4/1931 Sigurd ..... D21F 9/04 162/212

(Continued)

FOREIGN PATENT DOCUMENTS

DE 186556 C 3/1906
FR 2918679 A1 * 1/2009 ..... D21F 9/043

(Continued)

OTHER PUBLICATIONS

Machine Translation of JP 60-139894, Published on Jul. 24, 1985. (Year: 1985).*

(Continued)

*Primary Examiner* — Jose A Fortuna
(74) *Attorney, Agent, or Firm* — Kratz, Quintos & Hanson, LLP

(57) ABSTRACT

To provide a sheet former capable of suitably regulating the thickness of a sheet forming body in a width direction in response to factors changing with time. A sheet former includes at least one vessel which stores slurry as a raw material, a wire cylinder immersed in the slurry inside the vessel and making sheets from solid components in the slurry while being rotated, and a sheet-forming amount regulator which regulates an amount of the solid components for making sheets by the wire cylinder in a width direction in accordance with a thickness of a sheet forming body in the approximately width direction formed for making sheets by the wire cylinder.

6 Claims, 7 Drawing Sheets

(58) Field of Classification Search
USPC ..... 162/323–335
See application file for complete search history.

(56) References Cited

U.S. PATENT DOCUMENTS

| | | | | | |
|---|---|---|---|---|---|
| 2,191,999 | A * | 2/1940 | Thaler | D21F 9/04 | 162/323 |
| 2,200,002 | A * | 5/1940 | Lane | D21F 9/04 | 162/318 |
| 2,243,773 | A * | 5/1941 | Randell | D21F 9/04 | 162/327 |
| 2,339,730 | A * | 1/1944 | Vedder | D21F 1/06 | 162/323 |
| 2,951,784 | A * | 9/1960 | Moore | D21F 9/04 | 162/212 |
| 3,021,899 | A * | 2/1962 | Goldsmith | D21F 9/04 | 162/327 |
| 3,065,787 | A * | 11/1962 | Rescheneder | D21F 9/04 | 162/327 |
| 3,111,454 | A * | 11/1963 | Tucker | D21F 9/04 | 162/297 |
| 3,397,112 | A * | 8/1968 | Highton | C07C 1/30 | 162/203 |
| 3,477,905 | A * | 11/1969 | Rogers, Jr. | D21J 1/00 | 162/203 |
| 3,554,866 | A * | 1/1971 | Wynstra | D21F 9/04 | 162/321 |
| 3,556,938 | A * | 1/1971 | Ohta et al. | D21H 13/44 | 162/306 |
| 3,573,163 | A * | 3/1971 | Neifeld et al. | B28B 1/527 | 162/323 |
| 3,856,617 | A * | 12/1974 | Fukuzaki | D21F 9/04 | 162/276 |
| 4,543,159 | A * | 9/1985 | Johnson | C04B 28/04 | 162/164.1 |
| 6,176,976 | B1 * | 1/2001 | Carter | D21F 1/043 | 162/259 |
| 6,824,715 | B2 * | 11/2004 | Cottier | B28B 1/522 | 264/101 |
| 7,510,630 | B2 * | 3/2009 | Zilker | D21F 9/043 | 162/208 |
| 8,157,965 | B2 * | 4/2012 | Saito | D21F 1/56 | 162/263 |
| 2002/0195214 | A1 * | 12/2002 | Cabrera y Lopez Caram | D21F 1/046 | 162/100 |
| 2005/0173086 | A1 * | 8/2005 | Waters | D21F 1/44 | 162/140 |
| 2006/0237157 | A1 * | 10/2006 | Zilker | D21F 9/043 | 162/208 |
| 2017/0175330 | A1 * | 6/2017 | Saito | D21F 1/043 | |

FOREIGN PATENT DOCUMENTS

| | | | | |
|---|---|---|---|---|
| JP | 19563 | C2 | 3/1911 | |
| JP | S60-139894 | | 7/1985 | |
| JP | 2001-140184 | A1 | 5/2001 | |
| WO | WO-2006115796 | A1 * | 11/2006 | D21F 9/043 |

OTHER PUBLICATIONS

Machine Translation of JP 2001-1240184 A1, Published on May 22, 2001 (Year: 2001).*

International Search Report for International Application No. PCT/JP2015/003659 dated Oct. 27, 2015.

English Translation of Written Opinion of ISA for International Application No. PCT/JP2015/003659 discussing JP 19563, JP 2001-140184 and JP S60-139894 (2 Sheets) dated Oct. 27, 2015.

Extended European Search Report for counterpart EPC Patent Application No. 15825571.1 dated Jan. 31, 2018 (5 Sheets).

* cited by examiner

[FIG. 1]
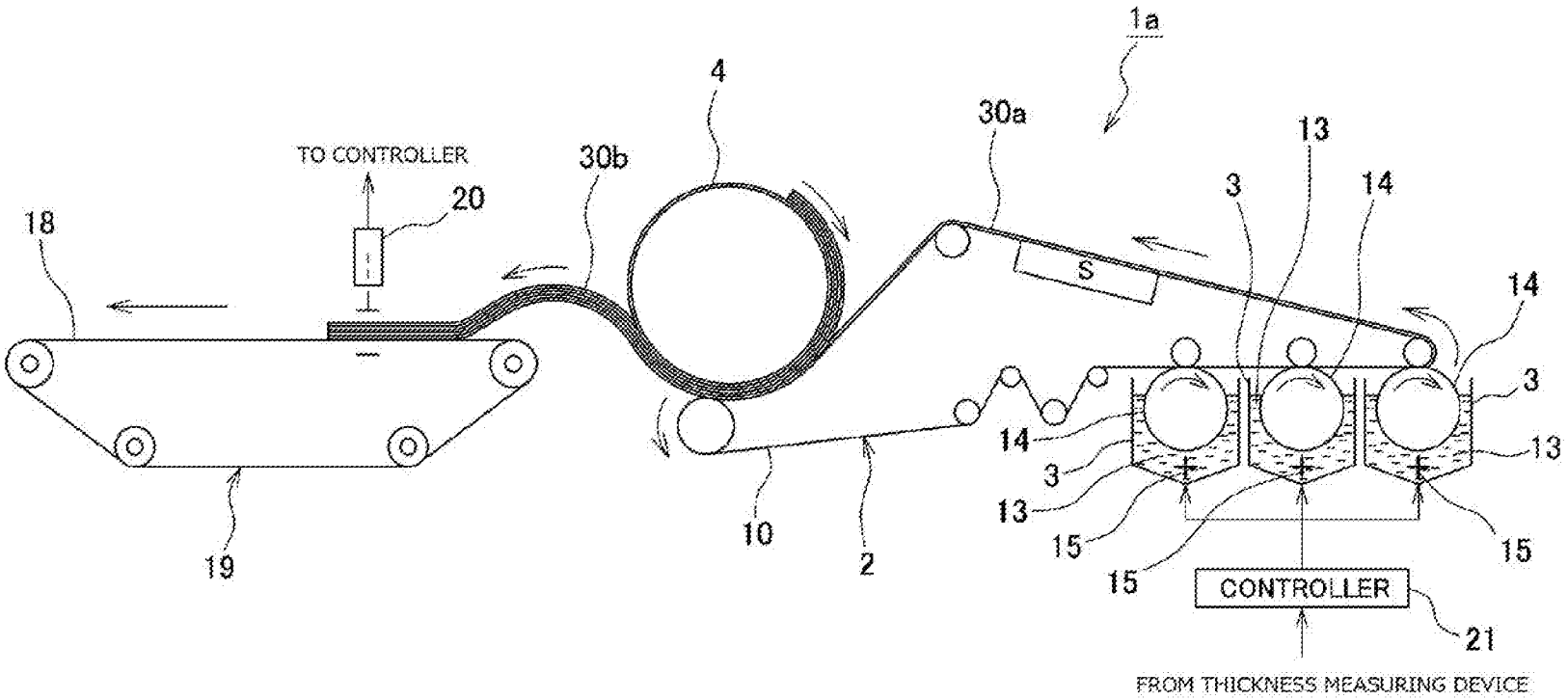

[FIG. 2]
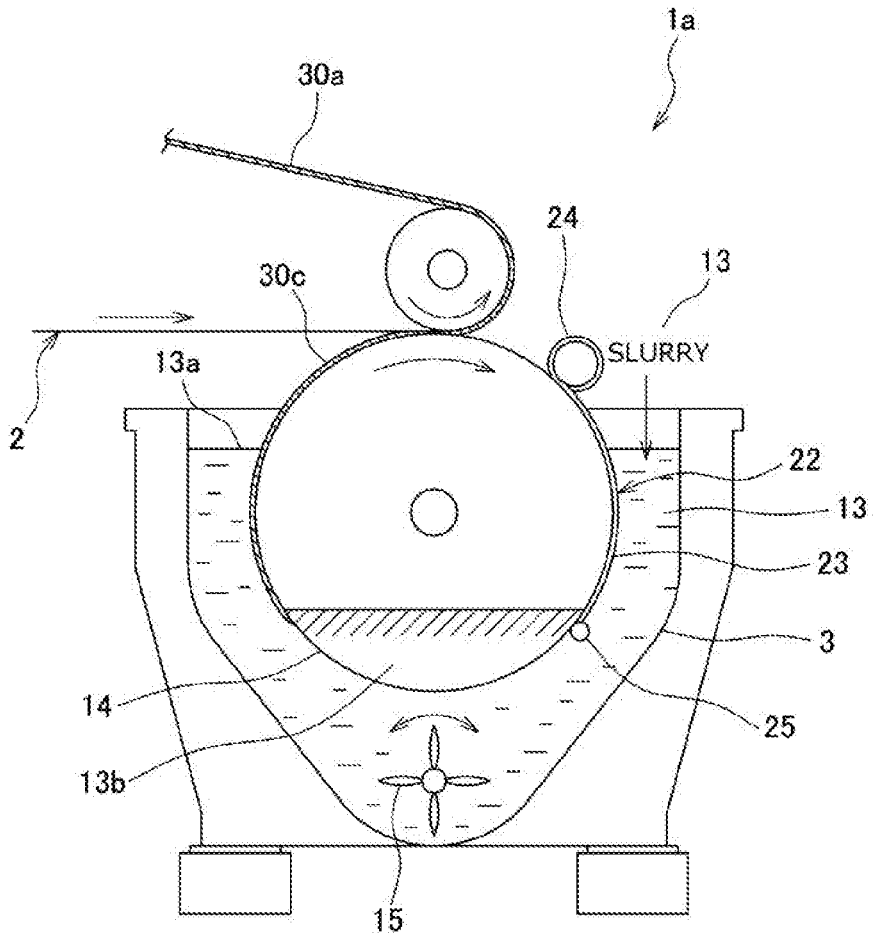

[FIG. 3]
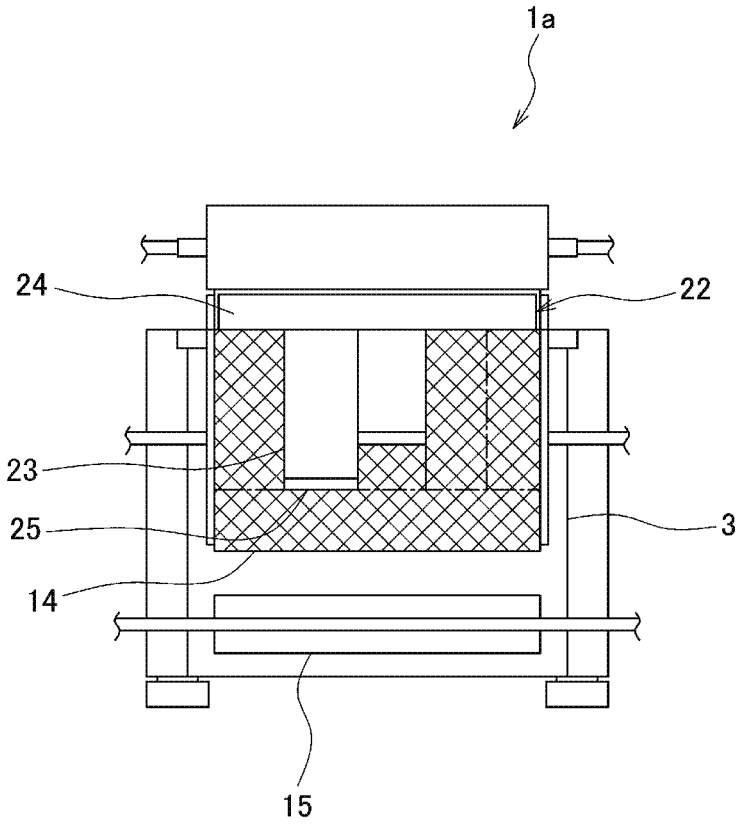

[FIG. 4]
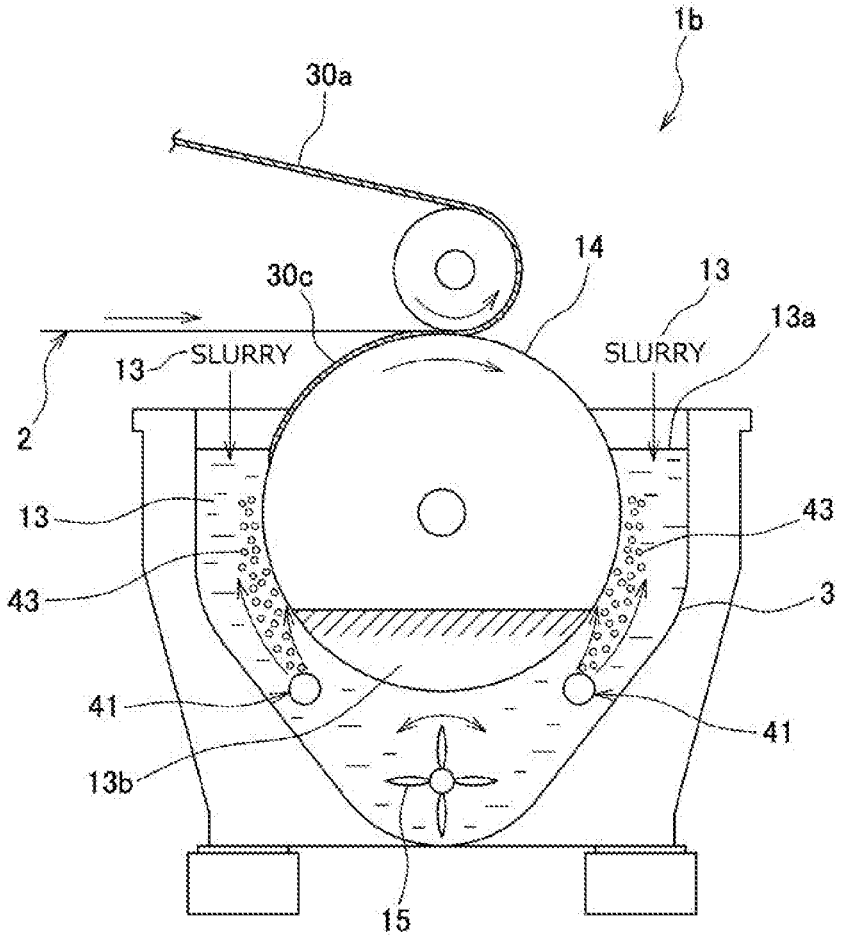

[FIG. 5]
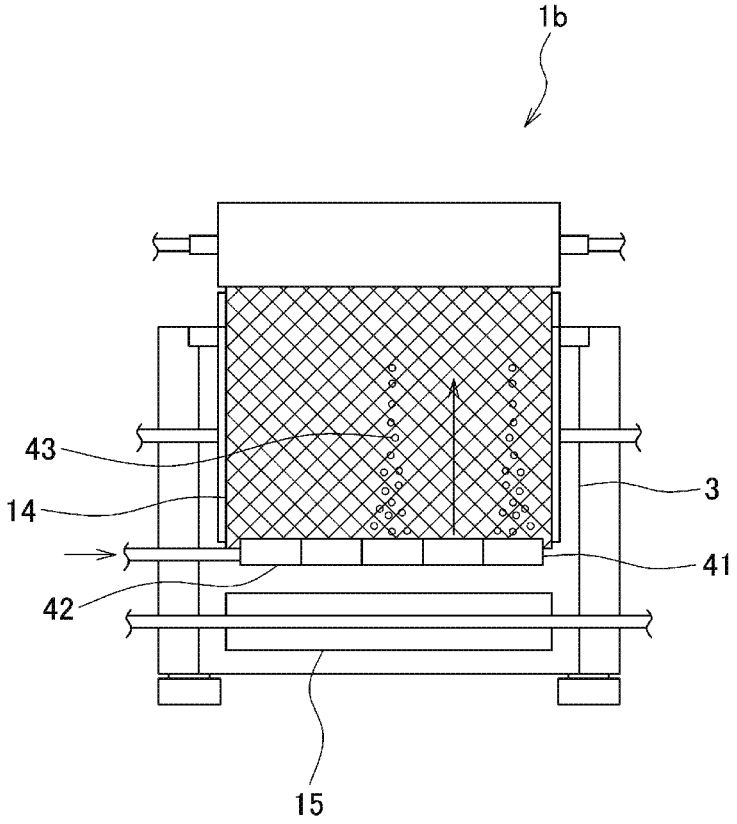

[FIG. 6]
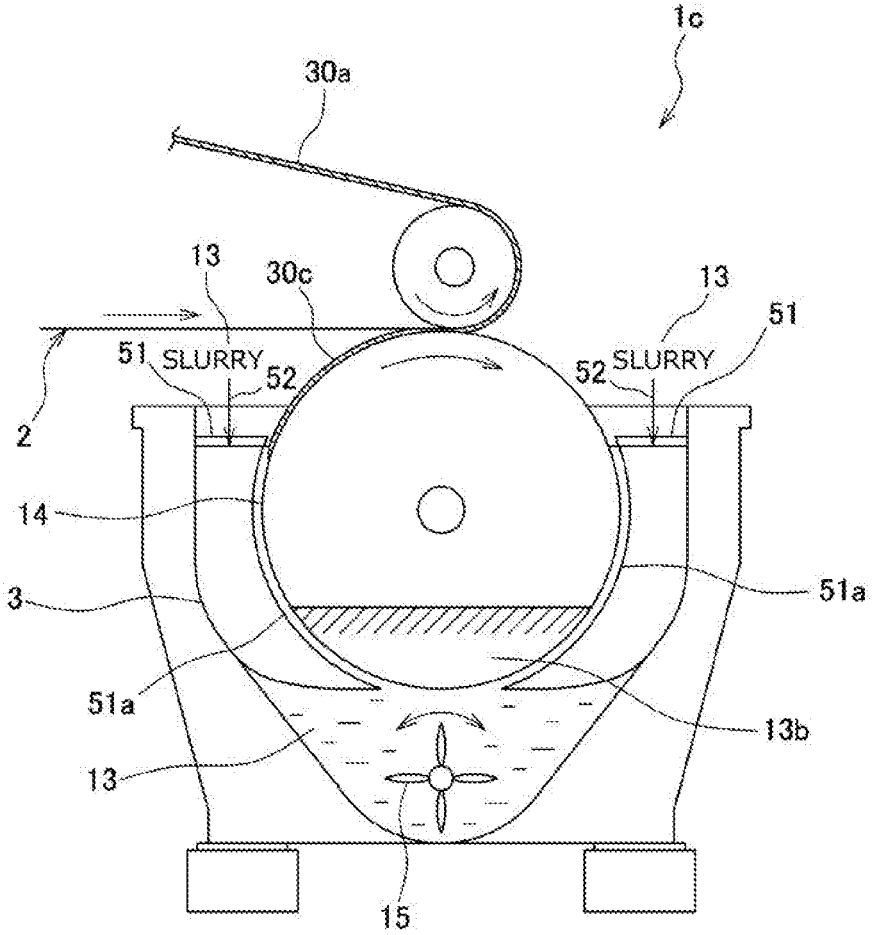

[FIG. 7]
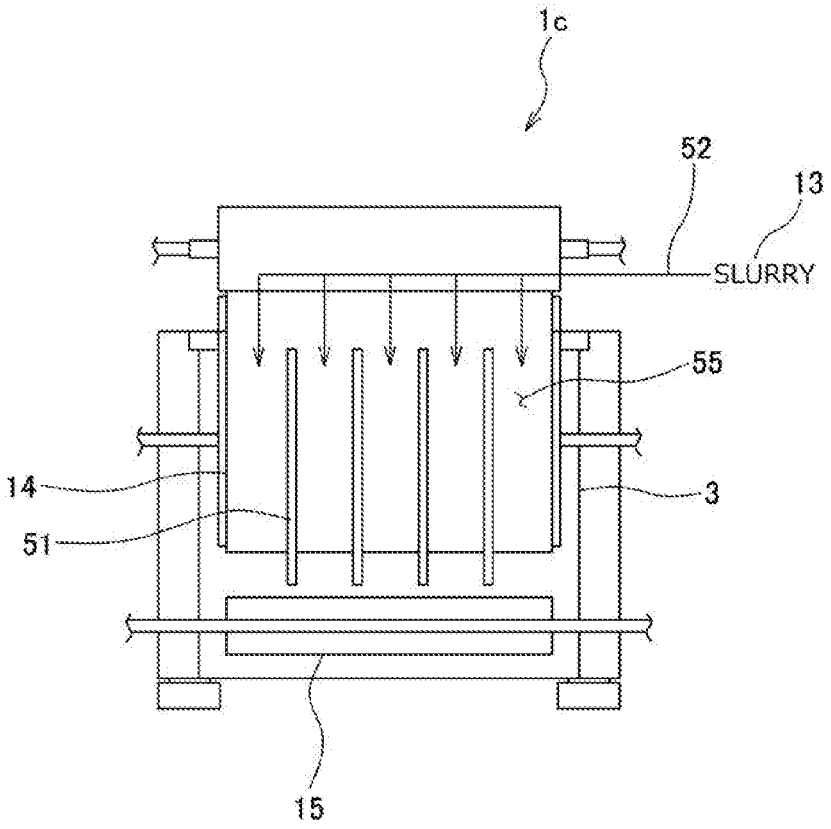

SHEET FORMER

TECHNICAL FIELD

The present invention relates to a cylinder type sheet former capable of reducing variations in thickness of a sheet forming body.

BACKGROUND ART

A board material such as a fiberboard which is manufactured from a slurry-type material is manufactured through a sheet forming process using a sheet forming method. In the manufacture, the sheet forming process using a cylinder type sheet former includes a process of making sheets from the slurry-type material by one or plural cylindrical nets and a process of winding solid components (sheet forming body) formed by making sheets while stacking layers.

This sheet forming method may cause thickness variations of approximately 5 to 30% in a width direction of the manufactured board material as a finished product due to various kinds of factors. As these factors, concentration of materials (quantity of mineral materials or fiber materials) and viscosity thereof, states of a fiber length and a particle diameter, fiber quality, stains in felt, a flow rate of materials, the degree of sinking of materials, time degradation of materials, a circulation direction and velocity by an agitator in a vessel and so on can be cited.

For example, a cylinder type sheet former capable of reducing variations in plate thickness is disclosed in JP-A 2013-112901. The cylinder type sheet former includes discharge means for discharging the slurry from vessels in first and second vessels for storing raw material slurry. The respective discharge means for the first vessel and the second vessel are provided at positioned opposite to each other with the cylindrical net interposed therebetween. According to the structure, the pressure distribution in the vessels can be regulated and variations in plate thickness can be reduced.

CITATION LIST

Patent Literature

SUMMARY OF INVENTION

Technical Problem

The cylinder type sheet former described in JP-A 2013-112901 considers only the pressure distribution in the vessels as the factor of variations in plate thickness. However, variations in thickness depend on various kinds of factors which change with time such as the concentration and viscosity of materials or stains in the felt. Therefore, the cylinder type sheet former described in JP-A 2013-112901 is not sufficient for obtaining a board material having a uniform plate thickness.

The present invention has been made in view of the above circumstances, and an object thereof is to provide a sheet former capable of suitably regulating the thickness of a sheet forming body in a width direction in response to factors changing with time.

Solution to Problem

To solve the above problem, the sheet former includes at least one vessel which stores slurry as a raw material, a wire cylinder immersed in the slurry inside the vessel and making sheets from solid components in the slurry while being rotated, and a sheet-forming amount regulator which regulates an amount of the solid components for making sheets by the wire cylinder in a width direction in accordance with a thickness of a sheet forming body in the approximately width direction formed for making sheets by the wire cylinder.

Advantageous Effects of Invention

In the sheet former according to the present invention, the thickness of the sheet forming body in the width direction can be suitably regulated in response to factors changing with time.

DESCRIPTION OF EMBODIMENTS

FIG. 1 is an overall configuration diagram showing a sheet former according to an embodiment of the present invention.

FIG. 2 is an explanatory view of the sheet-shaped regulator according to the first embodiment seen from the side.

FIG. 3 is an explanatory view of the sheet-shaped regulator according to the first embodiment seen from the front.

FIG. 4 is an explanatory view of an air bubble regulator according to a second embodiment seen from the side.

FIG. 5 is an explanatory view of the air bubble regulator according to the second embodiment seen from the front.

FIG. 6 is an explanatory view of partition plates according to the third embodiment seen from the side.

FIG. 7 is an explanatory view of the partition plates according to the third embodiment seen from the front.

FIRST EMBODIMENT

A sheet former according to a first embodiment of the present invention will be explained with reference to the attached drawings.

FIG. 1 is an overall configuration diagram showing a sheet former according to an embodiment of the present invention.

A sheet former 1*a* is used in a sheet forming process in manufacture of board materials such as a siding board, a silica board and a cement board as house construction materials. The sheet former 1*a* is a cylinder type sheet former, including a conveyor device 2, vessels 3, 3, 3 (hereinafter referred to merely as the vessels 3) and a winding roller 4.

The conveyor device 2 includes a sheet forming belt 10 formed of, for example, felt, which conveys a sheet forming body.

The vessels 3 are arranged under the conveyor device 2, storing a slurry 13 as a raw material. The single vessel 3 as well as the plural vessels 3 other than three vessels may be provided according to applications of the board material to be formed. Generally, the slurry 13 is constantly supplied to respective vessels 3. The slurry 13 may be supplied from a forward flow side as well as from a reverse flow side in the rotation direction of wire cylinders 14. The raw material is a mixture of a mineral material such as cement and a fiber material such as pulp.

In respective vessels 3, cylindrical wire cylinders 14, 14, 14 (hereinafter referred to merely as the wire cylinders 14) formed in a mesh state for making sheets from the material are arranged. The wire cylinders 14 are immersed in the slurry 13 and making sheets from solid components in the slurry 13 while being rotated. The wire cylinders 14 are arranged so that an axial direction thereof is approximately orthogonal to a feeding direction of a sheet forming belt 10. The wire cylinders 14 rotate at a rotation speed which can be adjusted by a not-shown driving source. Each wire cylinder 14 has a discharge means (not shown) for discharging a waste water 13*b* passed through the surface of the wire cylinder 14 from the side of the vessel 3 as shown in FIG. 2. Moreover, an agitator 15 (mixer) for preventing sedimentation of the slurry 13 is provided inside the vessel 3.

The winding roller 4 is rotatably provided on a downstream side in the feeding direction of the conveyor device 2. The winding roller 4 is provided for winding a sheet forming body 30*a* conveyed by the conveyor device 2. A cutting device (not shown) such as a cutter for cutting a sheet forming body 30*b* obtained after the winding of a given number of layers is completed is disposed near the winding roller 4. On a downstream side of the winding roller 4, a conveyor device 19 having a transfer belt 18 is further provided. The sheet forming body 30*b* cut from the winding roller 4 is transferred to a subsequent stage by the transfer belt 18.

The sheet former 1*a* according to the embodiment has a thickness measuring device 20. The thickness measuring device 20 measures thicknesses (thicknesses of plural positions in the width direction) of the sheet forming body 30*b* formed by making sheets by the wire cylinders 14 in an approximately width direction (direction approximately orthogonal to the feeding direction of the conveyor devices 2, 19). As the thickness measuring device 20, various types of devices such as a non-contact optical device and an electrostatic capacitance type device may be used. Thickness information measured by the thickness measuring device 20 is transmitted to a controller 21. The controller 21 controls a sheet-shaped regulator 22 (FIG. 2) based on the thickness information.

FIG. 2 is an explanatory view of the sheet-shaped regulator 22 according to the first embodiment seen from the side.

FIG. 3 is an explanatory view of the sheet-shaped regulator 22 according to the first embodiment seen from the front. In FIG. 3, only two sheet pieces 23 are used in five sheet pieces 23, and other three pieces 23 are shown by virtual lines.

The controller 21 and the sheet-shaped regulator 22 are provided as a sheet forming amount regulator. The sheet forming amount regulator regulates the amount of solid components for forming sheets with the wire cylinder 14 in the approximately width direction according to the thickness of the sheet forming body 30*b* in the approximately width direction measured by the thickness measuring device 20.

The sheet-shaped regulator 22 covers at least part of the surface of the wire cylinder 14 in a circumferential direction by the sheet pieces 23 divided into plural pieces in the width direction of the wire cylinder 14. Accordingly, the sheet-shaped regulator 22 reduces an amount of a sheet forming body 30*c* for making sheets by the wire cylinder 14. In FIG. 2 and FIG. 3, the sheet pieces 23 cover from a slurry water surface 13*a* inside the vessel 3 to an upper part of the lower end of the wire cylinder 14. The sheet-shaped regulator 22 is controlled by the controller 21, thereby moving upward and downward in units of sheet pieces 23 by a winding part 24. The sheet pieces 23 are sheet-shaped members formed of, for example, a steel material, a resin material, a fabric material and so on, which may be members through which the raw material does not penetrate as well as may be mesh-shaped members through which a given volume of material penetrates. It is preferable that each sheet piece 23 has a weight 25 at an end portion thereof so that each sheet piece 23 properly covers the surface of the wire cylinder 14 inside the slurry 13.

Next, operations of the sheet former 1*a* according to the first embodiment will be explained.

The sheet forming belt 10 is allowed to travel in a state where the slurry 13 is stored in the vessels 3, and the wire cylinders 14 are allowed to rotate so as to correspond to the speed of the sheet forming belt 10. The raw material in the slurry 13 of each vessel 3 adheres to (forms a sheet on) the surface of the wire cylinder 14 as the sheet forming body 30*c* due to the water head difference (osmotic pressure) between the raw material and the waste water 13*b* in the wire cylinder 14. The sheet forming body 30*c* is sequentially transferred to the surface of the sheet forming belt 10 from the surface of the wire cylinder 14 as the wire cylinder 14 rotates. The waste water 13*b* mostly containing water including part of the raw material which has not adhered (has not formed a sheet) penetrates through the mesh-shaped surface on the surface of the wire cylinder 14 and enter the inside of the wire cylinder 14. The waste water 13*b* is discharged to the outside from the side of the vessel 3 by a discharging means (not shown).

One layer of the sheet forming body 30*c* is stacked on the sheet forming belt 10 at the time when the sheet forming body 30*c* passes through each vessel 3, and finally, three layers of sheet forming bodies 30*a* are formed at a stage where the sheet forming body 30*c* passes through all vessels 3.

The sheet forming body 30*a* is continuously fed to the downstream side by the sheet forming belt 10, and is wound by the winding roller 4 when the sheet forming body 30*a* is fed to the winding roller 4. The sheet forming body 30*a* wound by the winding roller 4 is cut on the winding roller 4 by the cutting device when the sheet forming body 30*a* is wound to have a given thickness, which is peeled off from the winding roller 4. The cut sheet forming body 30*b* is transferred by the transfer belt 18.

The sheet forming body 30*b* formed as described above is measured by the thickness measuring device 20 on the transfer belt 18, thereby obtaining thickness information of the sheet forming body 30*b* in the approximately width direction. The controller 21 acquires thickness information and controls the sheet-shaped regulator 22. That is, the surface of the wire cylinder 14 is covered by respective divided plural sheet pieces 23, thereby reducing (changing) the surface area of the wire cylinder 14 contacting the slurry 13, or the sheet forming body 30*c* adhering to the wire cylinder 14 is scraped, thereby regulating the amount of solid components. In the case where the sheet pieces 23 is formed in the mesh shape, the raw material penetrating through the sheet pieces 23 is used for forming sheets. Even in such case, the amount of solid components is regulated (adjusted) by increasing the resistance with respect to the sheet forming by the sheet pieces 23. The controller 21 regulates (reduces) the amount of solid components by the kinds (positions) and the number of the sheet pieces 23 which cover the surface of the wire cylinder 14 or a lowering amount of the winding part 24 (the area covering the wire cylinder 14).

For example, when the controller 21 judges that a thickness of the sheet forming body 30*b* at the center in the width direction is higher than that of both ends by 0.2 mm, the controller 21 determines the sheet pieces 23 which cover the wire cylinder 14 and determines a given lowering amount based on an regulation amount previously recorded in a database. It is preferable to perform regulation, for example, so that the lowering amount of the sheet pieces 23 is gradually increased toward the sheet piece 23 at the center. A difference between thicknesses in the central portion and both ends of the sheet forming body 30*b* continuously changes. Accordingly, it is preferable that the lowering amount of the sheet pieces 23 is constantly changed by the control of the controller 21. The sheet-shaped regulator 22 may be used in all three vessels 3 as well as may be used only in one vessel 3 according to the regulation amount of the thickness.

Due to the operation of the sheet-shaped regulator 22, the amount of solid components in the slurry 13 forming the sheets on the wire cylinder 14 is regulated, thickness variations in the width direction occurring in the sheet forming bodies 30*a*, 30*b* are cancelled and a board material as a smooth finished product can be obtained.

The sheet former 1*a* according to the first embodiment can obtain variations in thickness of the sheet forming body 30*b* in the width direction which changes with time in real time, thereby regulating the sheet forming amount by the wire cylinder 14. As the sheet-shaped regulator 22 can be provided in each wire cylinder 14, the thickness of the sheet forming body 30*c* formed on the wire cylinder 14 which is the minimum unit of the laminated sheet forming body 30*b* can be a target for regulation.

In related art, variations in thickness in the width direction occurring in the sheet forming body 30*b* are finally adjusted by performing pressing or by scraping with a sander, therefore, wasteful materials, wasteful manufacturing energy and so on occur. In response to this, the sheet former 1*a* according to the first embodiment can make adjustment of the sheet forming amount finely, and the thickness in the width direction of the sheet forming body 30*b* to be finally obtained can be made uniform.

Solid components of the slurry 13 may adhere to the sheet-shaped regulator 22. When the solid components of the slurry 13 adhere thereto, an error may occur with respect to a desired regulation amount determined by the controller 21. In order to solve the above, the sheet-shaped regulator 22 may have a cleaning means. The cleaning means is, for example, a doctor device (spatula) for scraping solid components adhering to respective sheet pieces 23 of the sheet-shaped regulator 22 or a shower (water).

The sheet-shaped regulator 22 is arranged so as to correspond to the rotation direction of the wire cylinder 14. That is, the sheet-shaped regulator 22 is arranged so that the sheet pieces 23 move downward along the rotation direction of the wire cylinder. The sheet-shaped regulator 22 may also be arranged so that the sheet pieces 23 move downward along a reverse direction of the rotation direction of the wire cylinder 14 to change the surface area of the wire cylinder 14 or the sheet forming body 30*c* which forms the sheet may be peeled (scraped) to reduce the adhering amount.

SECOND EMBODIMENT

A sheet former according to a second embodiment of the present invention will be explained based on the attached drawings.

FIG. 4 is an explanatory view of an air bubble regulator 41 according to the second embodiment seen from the side.

FIG. 5 is an explanatory view of the air bubble regulator 41 according to the second embodiment seen from the front.

A sheet former 1*b* according to the second embodiment differs from the sheet former 1*a* according to the first embodiment in a point that the sheet-forming amount regulator has the air bubble regulator 41 instead of the sheet-shaped regulator 22. The same symbols are given to structures and portions corresponding to those of the first embodiment, and repeated explanation is omitted.

The air bubble regulator 41 (bubble regulator) pressurizes air bubbles 43 and injects the air bubbles 43 to the vicinity of the surface of the wire cylinder 14 from plural nozzles 42 provided in the width direction of the wire cylinder 14. The air bubble regulator 41 suppresses adhesion of solid components in the slurry 13 to the wire cylinder 14 by the air bubbles 43 sprayed from respective nozzles 42 (suppresses that solid components coming close to the wire cylinder 14 to form sheets). Accordingly, the air bubble regulator 41 regulates the amount of solid components.

In FIG. 4 and FIG. 5, the air bubbles 43 are generated upward from a depth corresponding to a lower end of the wire cylinder 14 to the slurry water surface 13*a* and an approximate surface of the wire cylinder 14. The air bubble regulator 41 is controlled by the controller 21 so that the air bubbles 43 can be injected from respective nozzles 42.

Next, operations of the sheet former 1*b* according to the second embodiment will be explained.

As shown in FIG. 1, the formed sheet forming body 30*b* is measured by the thickness measuring device 20 on the transfer belt 18 to obtain thickness information of the sheet forming body 30*b* in the approximate width direction. The controller 21 acquires thickness information and controls the air bubble regulator 41. That is, the air bubble regulator 41 injects the air bubbles 43 from required nozzles 42 to cover the surface of the wire cylinder 14 with the air bubbles 43, thereby changing the concentration and the like of the raw material at portions of the air bubbles 43. As a result, the air bubble regulator 41 regulates (reduces) the amount of solid components adhering to the wire cylinder 14.

The controller 21 regulates the amount of solid components by positions (injection places) of the nozzles 42 which inject the air bubbles 43 for covering the surface of the wire cylinder 14, the number of the nozzles 42 to be used, an injecting amount, an injecting speed, an injecting direction of the air bubbles 43 and so on.

Due to the above operation of the air bubble regulator 41, the amount of solid components in the slurry 13 forming the sheet on the wire cylinder 14 is regulated, thickness variations generated in the width direction of the sheet forming body 30*b* are cancelled and the board material as the smooth finished product can be obtained.

The sheet former 1*b* according to the second embodiment can obtain variations in thickness of the sheet forming body 30*b* in the width direction which changes with time in real time, thereby regulating the sheet forming amount by the wire cylinder 14.

The air bubble regulator 41 (nozzles 42) may also be provided with a cleaning means for removing solid components of the slurry 13 adhering to the nozzles 42. The cleaning means is, for example, a brush for removing solid components adhering to the nozzles 42 or a function of injecting air bubbles powerfully by the nozzles 42 periodically or at arbitrary timing.

The bubble regulator may be a water bubble regulator which injects water bubbles instead of air bubbles. The bubble regulator may also inject mixture of air bubbles and water bubbles. Moreover, the example in which two bubble regulators (air bubble regulators 41) are provided as shown in FIG. 4 has been explained in the second embodiment, however, any one of regulators may be provided. In the case where two bubble regulators are provided, the thickness can be regulated more effectively than in the case where one regulator is provided. Although the example in which the slurry is supplied both from the forward flow side and the reverse flow side is shown in FIG. 4, the slurry may be supplied only from any one of sides.

THIRD EMBODIMENT

A sheet former according to a third embodiment of the present invention will be explained with reference to the attached drawings.

FIG. 6 is an explanatory view of partition plates 51 according to the third embodiment seen from the side.

FIG. 7 is an explanatory view of the partition plates 51 according to the third embodiment seen from the front.

A sheet former 1*c* according to the third embodiment differs from the sheet former 1*a* according to the first embodiment in a point that the sheet-forming amount regulator has the partition plates 51 and a supply device 52 instead of the sheet-shaped regulator 22. The same symbols are given to structures and portions corresponding to those of the first embodiment, and repeated explanation is omitted.

A plurality of partition plates 51 are provided in the width direction of the wire cylinder 14. The partition plates 51 are boards formed of materials such as steel materials and resin materials. An end surface 51*a* (FIG. 6) of each partition plate 51 which faces the surface of the wire cylinder 14 does not contact the surface of the wire cylinder 14. That is, the end surface 51*a* is formed in an arc shape along the surface of the wire cylinder 14. That is for preventing the material formed on the surface of the wire cylinder 14 from being scratched. As the end surfaces 51*a* are formed along the surface of the wire cylinder 14, regions 55 are positively formed to end portions of the partition plates 51 to thereby regulates (adjust) the concentration and the quantity of the slurry 13 positively.

The supply device 52 supplies the slurry 13 to respective regions 55 partitioned by the partition plates 51. The supply device 52 has pipes, for example, divided into five so as to supply the slurry 13 to respective regions 55 as shown in FIG. 7. The supply device 52 is configured to adjust at least any of the quantity and the concentration of the slurry 13 supplied to respective pipes. Although the example in which the slurry 13 is supplied to respective regions 55 from pipes divided from a common pipe is shown in FIG. 7, independent pipes may be used. The supply device 52 may adjust supply amounts of the slurry 13 to be supplied to respective regions 55 by using a member such as a plate-shaped body.

Next, operations of the sheet former 1*c* according to the third embodiment will be explained.

As shown in FIG. 1, the formed sheet forming body 30*b* is measured by the thickness measuring device 20 on the transfer belt 18 to obtain thickness information of the sheet forming body 30*b* in the approximately width direction. The controller 21 acquires thickness information and controls at least any of the concentration and the quantity of the slurry 13 supplied to respective regions 55 by the supply device 52. That is, the supply device 52 adjusts (increases or reduces) and supplies the slurry 13 in which the quantity or the concentration as parameters affecting the thickness of the sheet forming body 30*b* are adjusted in units of regions 55 in accordance with the obtained thickness information.

Due to the above operation of the partition plate 51 and the supply device 52, the amount of solid components in the slurry 13 forming the sheets on the wire cylinder 14 is regulated, variations in thickness in the width direction occurring in the sheet forming body 30*b* is cancelled and the board material as the smooth finished product can be obtained.

The sheet former 1*c* according to the third embodiment can obtain variations in thickness of the sheet forming body 30*b* in the width direction which changes with time in real time, thereby regulating the sheet forming amount by the wire cylinder 14.

The partition plate 51 may also be provided with a cleaning means for removing solid components of the slurry 13 adhering to the partition plates 51. The cleaning means is, for example, a brush or a doctor device for removing solid components adhering to the partition plates 51.

In the third embodiment, the example in which two sets of partition plates 51 and the supply devices 52 are provided as shown in FIG. 6 are shown, however, any one of them may be provided. When two sets of partition plates 51 and the supply devices 52 are provided, the thickness can be regulated more effectively as compared with the case where one of them is provided. Although the example in which the slurry is supplied both from the forward flow side and the reverse flow side is shown in FIG. 6, it is sufficient that the slurry is supplied from one side.

Some embodiments of the present invention have been explained, however, these embodiments are shown as examples and do not intend to limit the scope of the invention. These novel embodiments may be achieved in other various manners, and various omissions, replacement and alteration may occur within a scope not departing from the gist of the invention. These embodiments and modifications are included in the scope and the gist of the inventions and are included in inventions described in claims and the scope equivalent thereto.

For example, respective sheet-forming amount regulators according to the first to third embodiments may be provided by being combined with each other as well as plural regulators may be provided with respect to the wire cylinder (at opposite positions with a rotation axis of the wire cylinder interposed therebetween).

The thickness measuring device 20 may be provided on the winding roller 4 or at an upstream of the winding roller 4 (namely, on the sheet forming belt 10) to measure the thickness of each sheet forming body. That is, the setting position of the thickness measuring device 20 is not limited to an example shown in FIG. 1. It is not necessary that the thickness measuring device 20 is part of the sheet former. For example, thickness information may be obtained by using the thickness measuring device independent of the sheet former, and the thickness information may be provided to the controller 21. Thickness may be evaluated by visual recognition of a user (human being) and thickness information may be inputted to the controller 21.

Concerning the determination of the regulation amount, regulation amounts obtained by experiments may be previously stored in a database in units of variation patterns in thickness, and the regulation amount may be selected from the stored regulation amounts in accordance with obtained thickness information. An arithmetic unit may be provided in the sheet-forming amount regulator and the regulation amount may be calculated in real time in accordance with the obtained thickness information to decide the regulation amount.

The vessel 3 may be configured to be divided into two or more from the viewpoint of easiness in cleaning or maintenance of the sheet-shaped regulator 22, the air bubble regulator 41 and the partition plates 51.

REFERENCE SIGNS LIST

1*a*, 1*b*, 1*c* sheet former
2, 19 conveyor device
3 vessel
4 winding roller
10 sheet forming belt
13 slurry
13*b* waste water
14 wire cylinder
15 agitator
18 transfer belt
20 thickness measuring device
21 controller
22 sheet-shaped regulator
23 sheet piece
30*a*, 30*b*, 30*c* sheet forming body
41 air bubble regulator
42 nozzle
43 air bubbles
51 partition plate
52 supply device

The invention claimed is:

1. A sheet former comprising:

at least one vessel which stores slurry as a raw material;

a wire cylinder immersed in the slurry inside the vessel and making sheets from solid components in the slurry while being rotated; and a sheet-forming amount regulator which regulates an amount of the solid components for making sheets by the wire cylinder in a width direction and in accordance with a thickness of a sheet forming body, in the substantially width direction when the sheets are made by the wire cylinder, wherein the sheet-forming amount regulator includes a sheet-shaped regulator covering at least part of the surface of the wire cylinder in a circumferential direction by sheet pieces divided into plural pieces in a width direction of the wire cylinder, which regulates the amount of solid components by covering the surface of the wire cylinder by each divided sheet piece.

2. The sheet former according to claim 1, further comprising:

a thickness measuring device which measures the thickness in the width direction.

3. The sheet former according to claim 2, wherein the sheet-forming amount regulator includes a bubble regulator injecting bubbles to the vicinity of the surface of the wire cylinder from plural nozzles provided along the width direction of the wire cylinder, which regulates the amount of solid components by suppressing adhesion of the solid components by bubbles sprayed from respective nozzles.

4. The sheet former according to claim 2, wherein the sheet-forming amount regulator includes plural partition plates provided in the width direction of the wire cylinder and a supply device supplying the slurry to respective regions partitioned by the partition plates, which regulate the amount of solid components by regulating at least any of a quantity and a concentration of the slurry supplied to respective regions by the supply device.

5. The sheet former according to claim 1, wherein the sheet-forming amount regulator includes a bubble regulator injecting bubbles to the vicinity of the surface of the wire cylinder from plural nozzles provided along the width direction of the wire cylinder, which regulates the amount of solid components by suppressing adhesion of the solid components by bubbles sprayed from respective nozzles.

6. The sheet former according to claim 1, wherein the sheet-forming amount regulator includes plural partition plates provided in the width direction of the wire cylinder and a supply device supplying the slurry to respective regions partitioned by the partition plates, which regulate the amount of solid components by regulating at least any of a quantity and a concentration of the slurry supplied to respective regions by the supply device.

* * * * *